US007717834B2

(12) United States Patent
Kay

(10) Patent No.: US 7,717,834 B2
(45) Date of Patent: May 18, 2010

(54) THERAPEUTIC SHOULDER APPARATUS

(76) Inventor: Scott A. Kay, 564 Lee Rd., 279, Salem, AL (US) 36874

( * ) Notice: Subject to any disclaimer, the term of this patent is extended or adjusted under 35 U.S.C. 154(b) by 0 days.

(21) Appl. No.: 11/904,570

(22) Filed: Sep. 27, 2007

(65) Prior Publication Data

US 2008/0312053 A1 Dec. 18, 2008

Related U.S. Application Data

(60) Provisional application No. 60/934,246, filed on Jun. 12, 2007.

(51) Int. Cl.
*A63B 20/02* (2006.01)

(52) U.S. Cl. ..... 482/124; 482/139; 482/148

(58) Field of Classification Search ..... 482/124, 482/148, 139, 38, 44–46, 51, 905; 128/882; 602/20–22, 60–64, 5
See application file for complete search history.

(56) References Cited

U.S. PATENT DOCUMENTS 1,378,578 A * 5/1921 Bauman ..... 623/65
1,639,815 A * 8/1927 Siebrandt ..... 602/16
2,415,288 A * 2/1947 Jordan ..... 602/20
2,838,310 A * 6/1958 Redka ..... 473/590
3,013,799 A * 12/1961 Wise ..... 482/118
3,089,700 A * 5/1963 Hotas ..... 482/94
3,159,923 A * 12/1964 Daniels et al. ..... 33/512
4,483,532 A 11/1984 Sparks
4,489,716 A * 12/1984 Blackwood et al. ..... 602/20
4,807,609 A * 2/1989 Meals ..... 602/20
4,919,435 A * 4/1990 McKinney ..... 273/339
4,944,508 A 7/1990 Collins
5,042,799 A * 8/1991 Stanley ..... 482/123
5,352,174 A 10/1994 Mason
5,383,844 A * 1/1995 Munoz et al. ..... 602/20
5,385,536 A * 1/1995 Burkhead et al. ..... 602/20
5,391,132 A * 2/1995 Greenwald ..... 482/91
5,407,420 A * 4/1995 Bastyr et al. ..... 602/5
5,520,615 A 5/1996 Fontana
5,538,499 A * 7/1996 Schwenn et al. ..... 602/20
5,564,451 A * 10/1996 Hagberg ..... 135/68
5,671,765 A * 9/1997 Hagberg, Jr. ..... 135/68
5,685,830 A * 11/1997 Bonutti ..... 602/16
5,746,705 A * 5/1998 Sheppard ..... 602/5
5,759,165 A * 6/1998 Malewicz ..... 602/21
5,842,896 A * 12/1998 Liveoak ..... 441/56
5,846,168 A * 12/1998 Murray ..... 482/105
5,951,499 A * 9/1999 Saringer et al. ..... 601/33
6,016,620 A * 1/2000 Morgan ..... 42/94
6,129,650 A 10/2000 Wedge (Continued)

*Primary Examiner*—Lori Baker

(57) ABSTRACT

In one embodiment, a shoulder exercise and stretching apparatus includes a forearm support, a forearm securing means for securing a user's forearm to the forearm support, an elbow support to capture the elbow of a user and keep the user's arm in a desired position to isolate the user's shoulder as a pivot point for rotation, and a rotation member coupled to the forearm support to rotate the forearm support through a desired plane and thereby provide an angular force to a target shoulder of the user. One or more handles, may be provided for grasping by a user's free hand to assist in the movement of the rotation member. Measurement means may be provided for determining the rotation of the apparatus. Resistance means may be provided to provide for resistance exercises of the shoulder.

18 Claims, 9 Drawing Sheets

U.S. PATENT DOCUMENTS 6,258,014 B1 * 7/2001 Karecki ..... 482/121
6,428,381 B1 * 8/2002 Stern ..... 446/36
6,569,067 B1 5/2003 Madole
6,595,937 B1 * 7/2003 Moon et al. ..... 602/5
6,739,993 B2 * 5/2004 Ben-Hador ..... 473/590
6,866,646 B2 * 3/2005 Hopkins et al. ..... 602/5
6,929,616 B2 * 8/2005 Bonutti et al. ..... 602/20
7,052,478 B1 * 5/2006 Bodenschatz et al. ..... 602/5
7,351,216 B2 * 4/2008 Walsh ..... 602/33
7,354,412 B2 * 4/2008 Verdonk et al. ..... 602/20
7,458,947 B2 * 12/2008 Farrell et al. ..... 602/21
7,475,490 B2 * 1/2009 Sawall et al. ..... 33/735
2003/0083160 A1 * 5/2003 Ben-Hador ..... 473/590
2003/0130600 A1 * 7/2003 Branch ..... 601/5
2003/0226262 A1 * 12/2003 Gambert ..... 30/276
2005/0065458 A1 * 3/2005 Kim ..... 602/5
2005/0080369 A1 * 4/2005 Kim ..... 602/12
2006/0008269 A1 * 1/2006 Woodman ..... 396/423
2006/0106328 A1 * 5/2006 Sieller et al. ..... 602/21
2007/0191748 A1 * 8/2007 Buethorn ..... 602/23
2007/0191749 A1 * 8/2007 Barberio ..... 602/23
2007/0225620 A1 * 9/2007 Carignan et al. ..... 601/5
2008/0079230 A1 * 4/2008 Graham ..... 280/87.041
2008/0161139 A1 * 7/2008 Comello ..... 473/451
2008/0243042 A1 * 10/2008 Balzer ..... 602/27
2009/0030353 A1 * 1/2009 Bonutti et al. ..... 601/5
2009/0048549 A1 * 2/2009 Verdonk et al. ..... 602/20

* cited by examiner

THERAPEUTIC SHOULDER APPARATUS

CROSS REFERENCE TO RELATED APPLICATIONS

This application claims the benefit of U.S. Provisional Application No. 60/934,246, filed Jun. 12, 2007.

FIELD OF THE INVENTION

The present invention relates to therapeutic devices. More particularly, the present invention relates to apparatus and methods for exercising and stretching the shoulder.

BACKGROUND OF THE INVENTION

It is often desirable to stretch and exercise a shoulder to increase the shoulder's strength, flexibility, and range of motion. For example, physical therapy programs, that include strengthening, stretching, and/or range of motion exercises, are often prescribed to assist a patient's recovery from shoulder injury. Assistive, passive exercises such as shoulder rotation and stretching exercises are generally recommended to rehabilitate the shoulder rather than active exercises. In a passive exercise, the shoulder is stretched and rotated in a manner that does not involve the tensing or exertion of the target shoulder muscles. In an active exercise, the target shoulder muscles are tensed or exerted during the exercise.

One therapeutic technique often employed is to stretch the shoulder through internal and external rotation. For example, a physical therapist may arrange the patient's arm in a desired position and rotate the arm through a desired rotation plane in order to stretch the shoulder. By supporting the user's arm and isolating the shoulder as a desired pivot point, a passive stretching is obtained which allows movement of the shoulder without tightening the target shoulder muscles. The therapist can move the arm into various positions to allow for both internal and external rotation of the shoulder in a variety of different planes. While this method works well, it requires the assistance of a physical therapist or other assistant to provide the necessary support and movement force.

Rehabilitation is most effective when a patient performs the exercises on a frequent basis, such as several times daily. Patient participation in an exercise program is usually increased if the patient can perform the exercises within the framework of his or her daily activities without the necessity of traveling to a special facility for ongoing supervision or specialized equipment. Exercise programs which can be performed by the patient in the home or the workplace without the assistance of a physician or physical therapist are desirable as it increases the availability and frequency of the exercise sessions.

But it is difficult for a patient to perform therapeutic programs without assistance from a physical therapist or other aide. Even with the aid of a physical therapist or other assistant, it has been proven difficult to apply a steady, safe, and consistent force to the shoulder for both internal rotation and external rotation. The extent to which the shoulder-related muscles are stretched or exercised can vary considerably between exercise sessions and even between different repetitions of the same session. When a person other than the patient is providing the force for the stretch, he must rely on the patient to tell him what the patient is feeling during the stretch, thereby making if difficult to determine the optimum stretch and obtain consistent exercises. Furthermore, it is difficult to document the amount of rotation or force exerted by the shoulder, thereby making it difficult to monitor a patient's performance and progress.

A number of shoulder rehabilitation devices have been developed. Most prior art devices, however, suffer from the fact that they are narrow in their purpose, only providing for movement in a limited number of planes and lacking the versatility to provide the full range of shoulder exercises that a patient may require. In addition, most devices do not provide for passive stretching in both internal and external rotation as well as both exercising and stretching. Furthermore, some equipment is large and bulky, making it difficult for a user to transport the device to the home and office, and thereby limiting the availability of the device and decreasing the frequency of sessions.

U.S. Pat. No. 5,352,174 to Mason discloses an active shoulder exercise system in which a patient moves his arm against the elastic resistance of an elastomeric tube while the device is anchored to the foot of the patient or a door jamb. While fit for its intended purpose, that device does not provide for passive movement, as it requires a user to grasp the device with the arm of the shoulder being rehabilitated, thereby tensing the shoulder muscles.

U.S. Pat. No. 5,520,615 to Fontana et al. discloses a self-assisted shoulder stretching and rotation machine in which one end of a rope is attached to each side of a forearm support to form a continuous loop. The patient lies in a supine position securing a forearm to the forearm support and pulling one end of the rope to move the forearm support in a first direction. While fit for its intended purpose, that device is not readily portable, does not provide for movement in a multitude of planes, is limited to a 180 degree range of motion (90 degree external and 90 degree internal), and requires that the patient be in a supine position.

Thus, there is a need for an apparatus and method that allows a user to perform passive stretching of the shoulder in both internal and external rotation and a broad range of shoulder stretches and exercises without the necessity of constant medical supervision or assistance from others. A shoulder apparatus is also needed which is portable and allows a user to perform exercises and stretches in a variety of different locations. A shoulder apparatus and method is also needed which provides for both stretching and exercise in an infinite number of planes. There is also a need for a shoulder stretching and exercise device that can be used by a user in a sitting, standing, supine or other position. There is also a need for an apparatus that allows a user to measure the stretching and exercise of the shoulder. There is also a need for an apparatus and method that fulfills the above-recited needs, yet which is relatively inexpensive to produce and maintain.

SUMMARY OF THE INVENTION

In one exemplary embodiment, a shoulder exercise and stretching apparatus is provided that includes a forearm support, a forearm securing means, such as a strap for securing a user's forearm to the forearm support, an elbow support to capture the elbow of a user and keep the user's arm in a desired position to isolate the user's shoulder as a pivot point for rotation, and a rotation member coupled to the forearm support to rotate the forearm support through a desired plane and thereby provide an angular force to a target shoulder of the user. One or more handles, such as an angled extension extending from an end of the rotation member, may be provided for grasping by a user's free hand to assist in the movement of the rotation member. The apparatus allows for the support of the user's arm in a manner that isolates the shoulder so that movement of the forearm support stretches the shoulder in a passive manner. By providing sufficient support to the arm, the shoulder can be stretched in an infinite number of different planes as desired by a user.

A resilient band may also be provided to the forearm support to allow a user to exercise the shoulder by moving the forearm against the resilient band. For example, the user may hold the apparatus in a desired position and exercise the shoulder by forcing his forearm against the resilient band. In an exemplary embodiment, the resilient band is a surgical tubing band, the resistance of which can be selected depending upon the particular needs of the user. Resistance measurement means may also be provided to determine the force exerted by a user against the resistance means.

In another exemplary embodiment, the invention may also include rotation measurement means, such as an inclinometer, to determine the amount of movement of the apparatus and the magnitude of rotation of a user's shoulder. For example, a user may measure the distance the arm rotates from an initial position to a rotated position and thereby determine the amount of rotation. In one exemplary embodiment, the inclinometer takes the form of a spirit level provided on the rotation member. The inclinometer may also take the form of an angle finder, digital protractor, or other device.

DETAILED DESCRIPTION

As required, exemplary embodiments of the present invention are disclosed herein. These embodiments are meant to be examples of various ways of implementing the invention and it will be understood that the invention may be embodied in alternative forms. The figures are not to scale and some features may be exaggerated or minimized to show details of particular elements, while related elements may have been eliminated to prevent obscuring novel aspects. Therefore, specific structural and functional details disclosed herein are not to be interpreted as limiting, but merely as a basis for the claims and as a representative basis for teaching one skilled in the art to variously employ the present invention.

Figure 1:
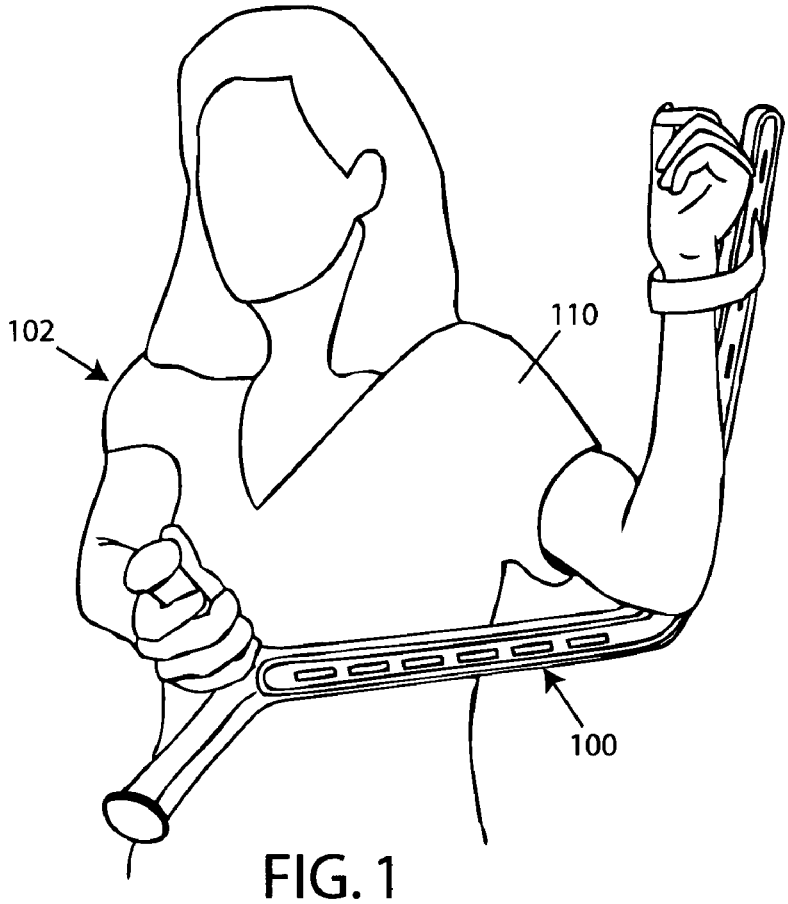
FIG. 1 shows a perspective view of a shoulder apparatus in accordance with an exemplary embodiment of the invention.

Turning to the figures, wherein like elements have like reference numbers throughout the several views, FIG. 1 shows a shoulder rehabilitation apparatus 100 being used by a user 102. The apparatus 100 may be used to stretch a target shoulder 110 of the arm to which it is attached. As explained in more detail below, the apparatus 100 may also be used to exercise a target shoulder 110 of the user.

Figure 2:
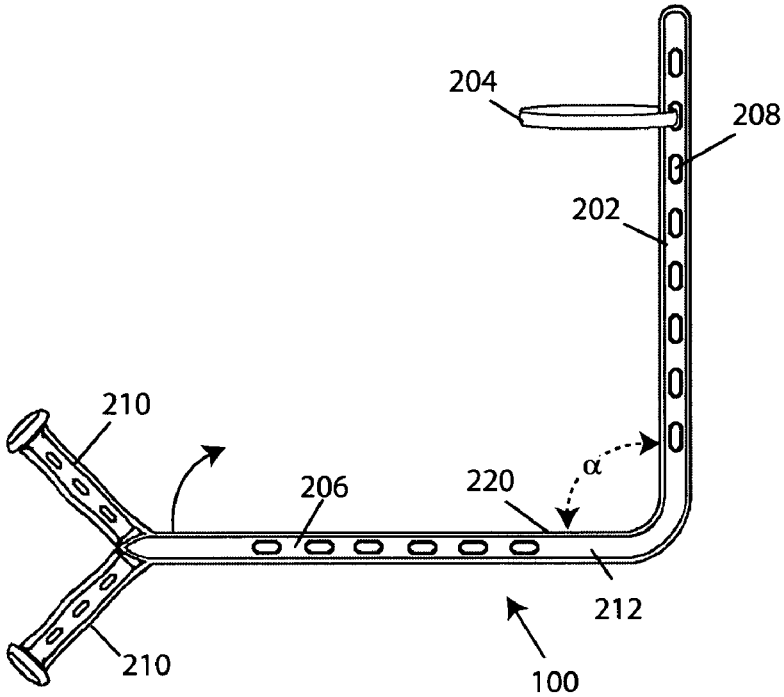
FIG. 2 shows a side view of the shoulder rehabilitation apparatus of FIG. 1.
Figure 3A:
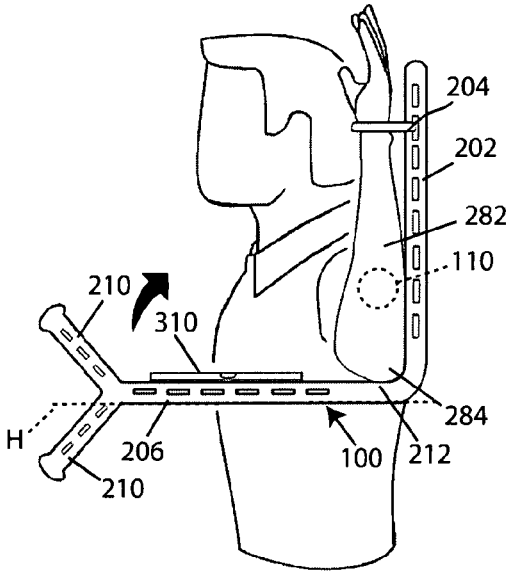
FIG. 3A shows a side view of a shoulder rehabilitation apparatus being used by a user in a starting position.

As shown in FIGS. 2 and 3A, the apparatus 100 may include a forearm support 202 that is adapted to support and assist movement of a user's forearm. A strap, shown in the form of an adjustable strap 204, may be provided to secure a user's forearm 282 to the forearm support 202 so that movement of the forearm support 202 results in movement of the user's forearm 282. A rotation member 206 coupled to the forearm support 202 may be grasped by a user's free hand (or by an assistant) and used to rotate the forearm support 202 in a desired direction such as shown by the arrow in FIG. 2. Because the user's forearm 282 is coupled to the forearm support 202 by the strap 204, movement of the rotation member 206 causes rotation of the user's upper arm 280 as the forearm 282 is moved, thereby providing a rotational force to the user's target shoulder 110 to stretch the target shoulder 110.

In the exemplary embodiment of FIG. 2, the strap 204 takes the form of an adjustable strap, such as a Velcro® strap, that is readily adjustable to the size of the user's arm. A plurality of receiving holes 208 may be provided in the forearm support 202 so that the strap 204 can be adjusted to the arm length of a particular user. A handle, such as hand extensions 210, may be provided on the rotation member 206 to assist the user in grasping the rotation member 206 with the user's free hand. To adjust the position of the strap 204 a user can simply thread the strap 204 through an appropriate receiving hole 208. Applicant has found that securing the user's forearm 282 near the wrist works well, but the arm may be secured at other locations or multiple locations through the use of multiple straps, if desired.

An elbow support 212 may also be provided to assist in capturing the user's elbow 284 and maintaining it in a desired relative position with the forearm 282 and shoulder 110. In the exemplary embodiment shown in FIG. 2, the elbow support 212 is provided in the form of a curved portion located at the junction of the elbow member 208 and the rotation member 206. Additional padding (not shown) may also be provided for additional comfort and support. The elbow support 212 may help establish a pivot point for the rotation of the apparatus 100 about the target shoulder 110.

Figure 4A:
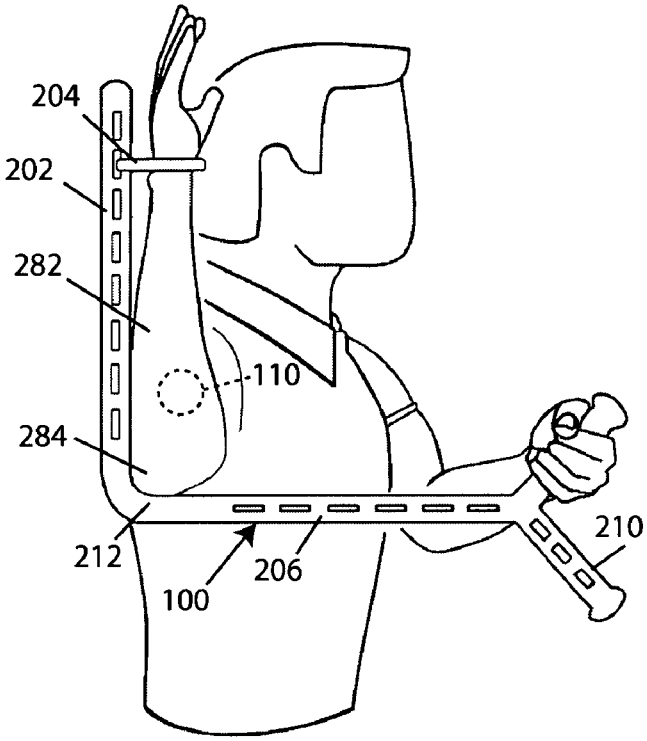
FIG. 4A shows a right side view of a user holding the shoulder rehabilitation apparatus in a first initial position for stretching the shoulder in a first stretch plane.
Figure 4B:
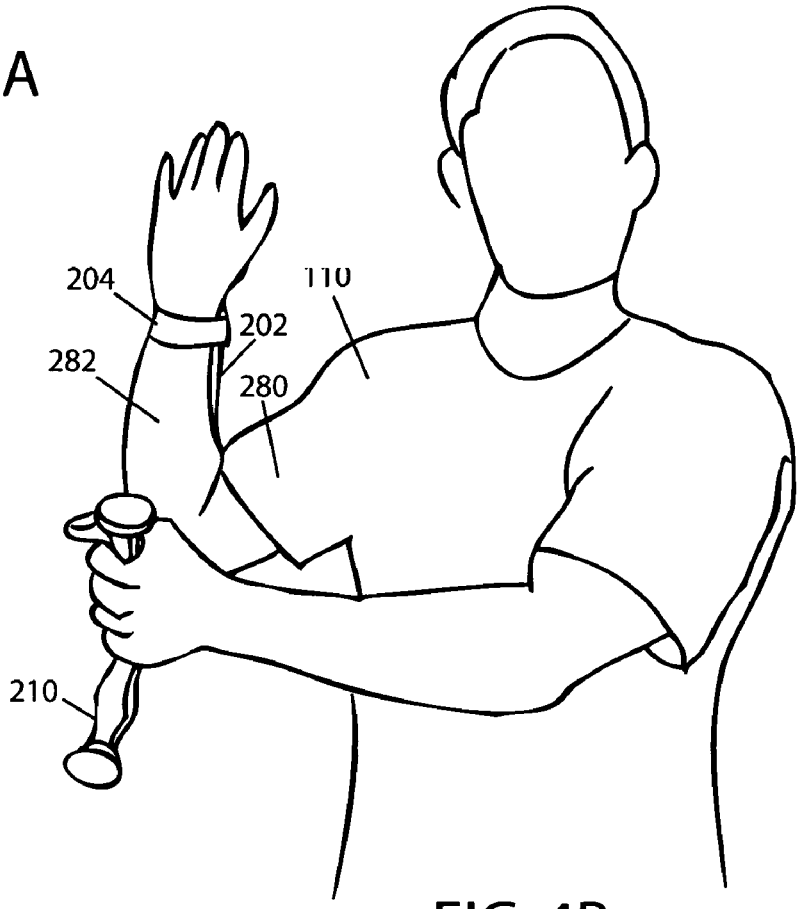
FIG. 4B shows a front view of the shoulder rehabilitation apparatus and user of FIG. 4A holding the shoulder stretch apparatus in an initial condition.
Figure 5B:
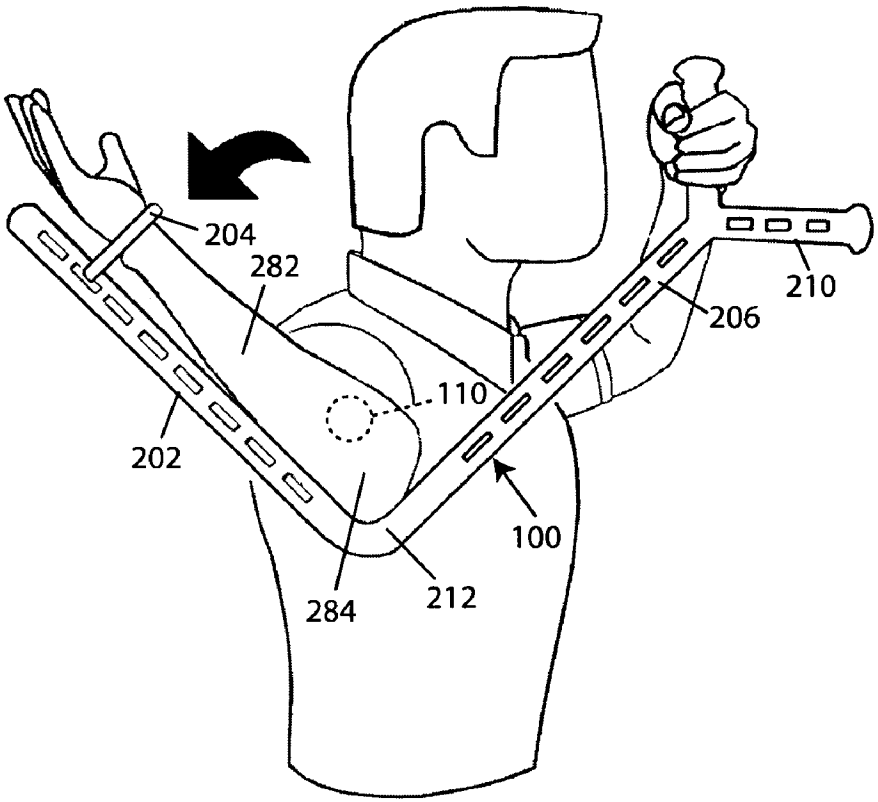
FIG. 5B shows a right side view of a user holding the shoulder rehabilitation apparatus in a rotated position to stretch the shoulder from the initial position shown in FIG. 5A.
Figure 5A:
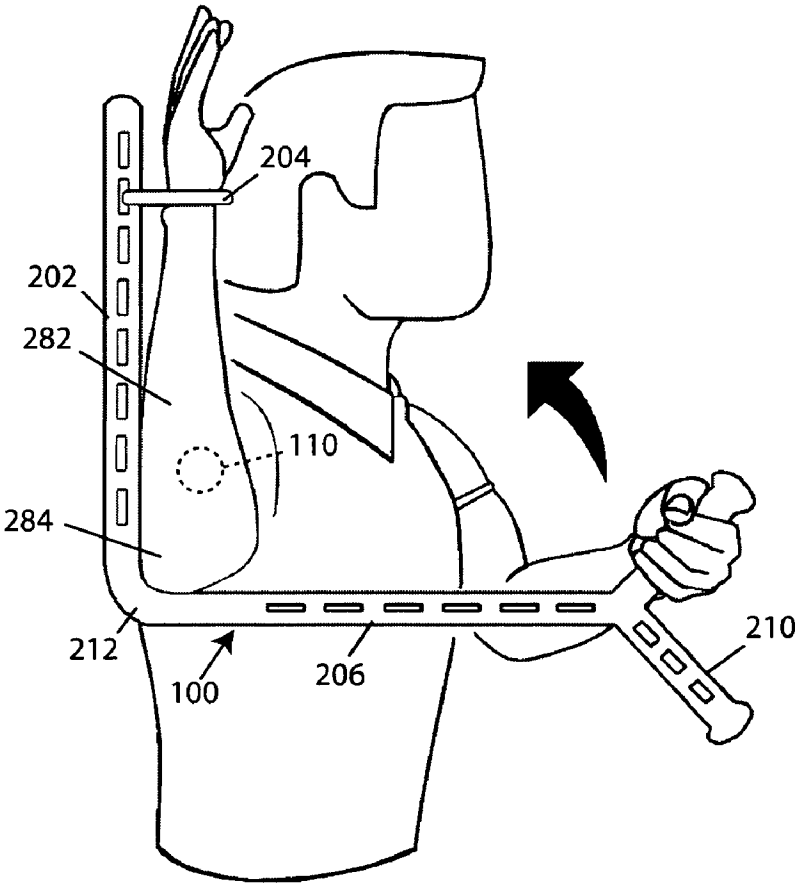
FIG. 5A shows a right side view of a user holding the shoulder rehabilitation apparatus in an initial position for stretching the shoulder of FIG. 4A showing the direction of rotation.

During therapeutic and rehabilitative stretching, rotation, and exercise of the shoulder 110, it may be desirable to maintain the forearm 282 at a generally 90 degree angle with reference to the upper arm 280 so that the arm is placed in a generally L-shaped position. In the exemplary embodiment of FIG. 2, the forearm support 202 and the rotation member 206 are provided at an angle of about 90 degrees. This allows a user to easily grasp the rotation member 206 and provides a comfortable initial position for stretching the shoulder 110 when the user's arm is in a desired position, such as an L-shape. For example, as shown in FIGS. 4A-4B, a user may hold the apparatus 100 in an initial position in which the rotation member 206 is generally horizontal and the forearm support 202 generally vertical. In this position, the upper arm 280 of the user extends outwardly from the user's side in a generally horizontal direction to extend perpendicular to the user's body so that the rotation member 206 extends forward generally perpendicular to the extension of the user's upper arm 280. The user's forearm 282 in turn extends upwardly in a generally vertical direction perpendicular to the upper arm 280 so that the arm forms an L-shape. The user may grasp an extension 210 to rotate the apparatus 100. In this position, as the forearm 282 is moved rearward as shown in FIGS. 5A-5B, a rotational force F, or torque, is provided at the user's shoulder 110 which serves as a pivot point for rotation. Thus, as the forearm 282 is moved by the forearm support 202, the upper arm 280 is rotated to provide torque to the user's shoulder 110. This movement may occur while the patient is standing, as shown in the figures, but it may also be performed when a patient is lying on his back in a supine position, sitting, or other positions. In addition, the stretching and rotation of the shoulder 110 may be performed in a passive state, (i.e., without tensing the target shoulder muscles), by using the user's free hand to provide the force to rotate the apparatus 100 and thereby cause movement in the target shoulder 110. The supine position removes the weight of the arm from the shoulder and minimizes movement of the scapula.

As mentioned above, the apparatus 100 may also include an elbow support 212 to support the user's elbow in a desired position. To assist in the rotation of the apparatus 100, the rotation member 206 may be coupled to the forearm support 202 and grasped with a user's free hand. The apparatus 100 is arranged so as to place the user's arm in a position to isolate the user's target shoulder 110 so that the target shoulder 110 serves as a pivot point for rotation of the apparatus 100 and a rotational force is provided to the shoulder 110. Thus, a user can easily rotate the apparatus 100 and thereby provide torque to the user's target shoulder 110 without tensing the target shoulder's 110 muscles. In the exemplary embodiment of FIG. 2, the elbow support 212 is located at the junction of the forearm support 202 and the rotation member 206. The elbow support 212 stabilizes the elbow to allow controlled rotation of the arm to stretch the target shoulder 110.

In the exemplary embodiment of FIG. 2, the elbow support 212 may be provided with an engagement surface 220 to support the user's elbow 284. The elbow support 212 may have a generally flat surface to provide surface area to support the elbow. As also seen in FIG. 2, the forearm support 212 and rotation member 206 may be coplanar and provided at an angle $\alpha$ which in the exemplary embodiment shown herein is approximately 90 degrees. The forearm support 202 and the rotation member 206 may be provided at other angles, such as, by way of example and not limitation, 45 degrees, 60 degrees or 135 degrees, but Applicant has found that a 90 degree angle works well to provide good elbow support and a desirable relative positioning of the forearm 282, the upper arm 280, and the shoulder 110 to isolate the shoulder 110 as a pivot point for rotation for most people.

Figure 3B:
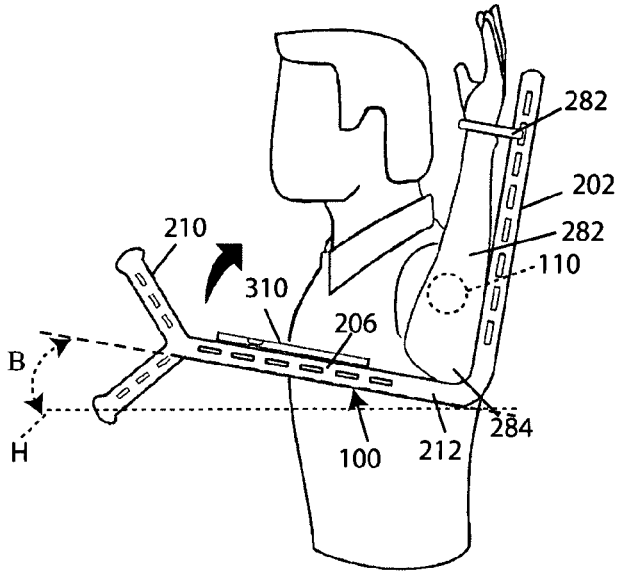
FIG. 3B shows the shoulder rehabilitation apparatus of FIG. 3A in a rotated position to stretch the shoulder.

As shown in FIG. 3A, in an initial position the user's elbow 284 may be placed on the elbow support 212 so that the user's forearm 282 is generally parallel with the forearm support 202. The adjustable strap 204 couples the user's forearm 282 to the forearm support 202. A measurement means, such as an inclinometer may be provided, such as a spirit level 310. In order to provide an external stretch of the shoulder 110, a force may be applied to the rotation member 206, such as by the user grasping an extension 210 attached to the rotation member 206 to rotate the apparatus 100 as shown by the arrow shown in FIG. 3A. Movement of the rotation member 206 results in rotation of the forearm support 202 and the user's forearm 282, which is secured to the forearm support 282 by the strap 204. This rotation results in a rotational force being applied to the shoulder 110 as shown in FIG. 3B. As also shown in FIG. 3B, the degree of rotation of the apparatus 100 may be indicated by the spirit level 310. This allows a user to keep track of his progress during the stretch. A user may be instructed by a doctor or physical therapist to rotate the apparatus 100 to a position as indicated by the inclinometer. For example, a user may be instructed to rotate the apparatus 100 a particular angle B (FIG. 3B) from a horizontal H position in which the rotation member 206 is horizontal, which would correspond with a particular reading on the spirit level 310 to provide a desired amount of rotation of the shoulder 110. The user may then perform exercises or stretches to obtain the appropriate reading on the spirit level 310 and thereby obtain consistent stretching. The user may use the inclinometer to track performance and progress of stretching as evidenced by increased rotation.

Figure 3C:
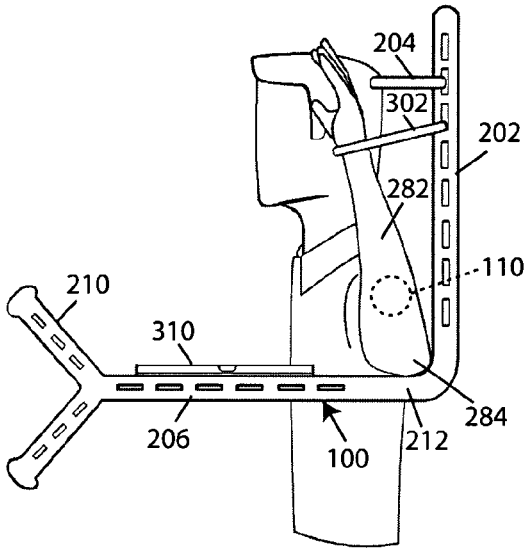
FIG. 3C shows a shoulder rehabilitation apparatus having a resistance means for exercising the shoulder.

In addition to stretching the shoulder, the apparatus 100 may also be used to exercise the shoulder 110 and strengthen the shoulder muscles. As shown in FIG. 3C a resistance means, such as a resilient band, shown in this example as a surgical tubing band 302, may be provided against which the user can move his forearm 282. For example, the user can hold the apparatus 100 stationary, such as by grasping a handle extension 210 with the user's free hand, and then move his forearm 282 against the resistance of a resilient band, such as the surgical tubing 302, to exercise the shoulder 110. A desired resistance can be obtained by selecting the resistance of the surgical tubing 302 or by adding or subtracting the number of surgical tubing bands 302 being used. For example, one or more surgical tubing 302 may be inserted through one or more apertures 208. As shown in FIG. 3C a securing strap 204 and a resilient band in the form of surgical tubing 302 may be provided to the apparatus 100 to allow a user to both stretch and exercise the shoulder. In addition, a user may use the resilient band to determine the amount of force that is applied to the forearm when attempting to stretch the shoulder. For example, in the event a user has difficulty moving his forearm and it stays in a stationary position, the user can rotate the apparatus 100 to apply force to the forearm 282 as discussed above. By providing a resilient band of a predetermined resistance value, a user can control the amount of force that is applied to the forearm, and hence the shoulder 110, during stretching. A force measurement means may also be provided to record the magnitude of the force applied by the shoulder during exercise when moving the forearm against the resilient band.

The present invention allows for both external and internal shoulder stretches in an infinite number of planes. This allows the apparatus to be used for a wide variety of different shoulder stretches and exercises, and the user can adapt the device to the particular exercises that are most effective for his particular needs. The phrase "internal rotation of the shoulder" means rotation of the shoulder caused by rotating the upper arm 280 inwardly toward the body. The term "external rotation of the shoulder" means rotation of the shoulder caused by rotating the head of the humerus of the upper arm in a direction opposite to the internal rotation, that is, outwardly and away from the body.

FIGS. 4A and 4B show an exemplary initial position of a user's arm with the apparatus 100 for performing stretching in a first desired plane. As seen in FIG. 4A the forearm support 202 may be in a generally vertical position with the rotation member 206 in a generally horizontal position so that the user's forearm 282 extends vertically and the upper arm 280 extends generally horizontally from the user's side so that the arm forms a general L-shape. The forearm support 202 is placed behind the user's forearm 282 with the strap 204 securing the user's forearm 282 to the apparatus 202. A user may grasp one of the handle extensions 210 to rotate the apparatus 202.

FIGS. 5A-5B, show a first rotation stretching exercise for stretching in a first plane in which a user may grasp a handle extension 210 with his free hand and move the rotation member 206 from an initial position (FIG. 5A) generally upward and back in the direction of the arrow into a rotated position (FIG. 5B) to cause movement of the user's forearm 282 in an arcing motion to provide a rotational force at the pivot point of the user's target shoulder 110.

Figure 6B:
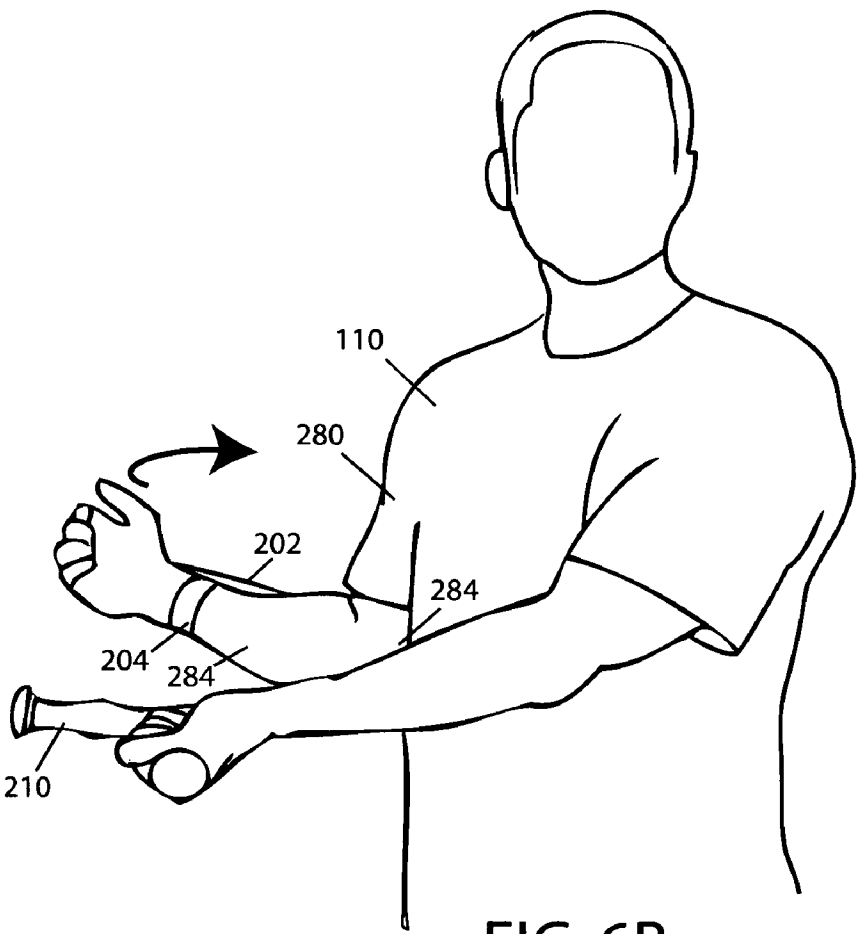
FIG. 6B shows a front view of a user holding the shoulder rehabilitation apparatus in FIG. 6A in a rotated position.
Figure 6A:
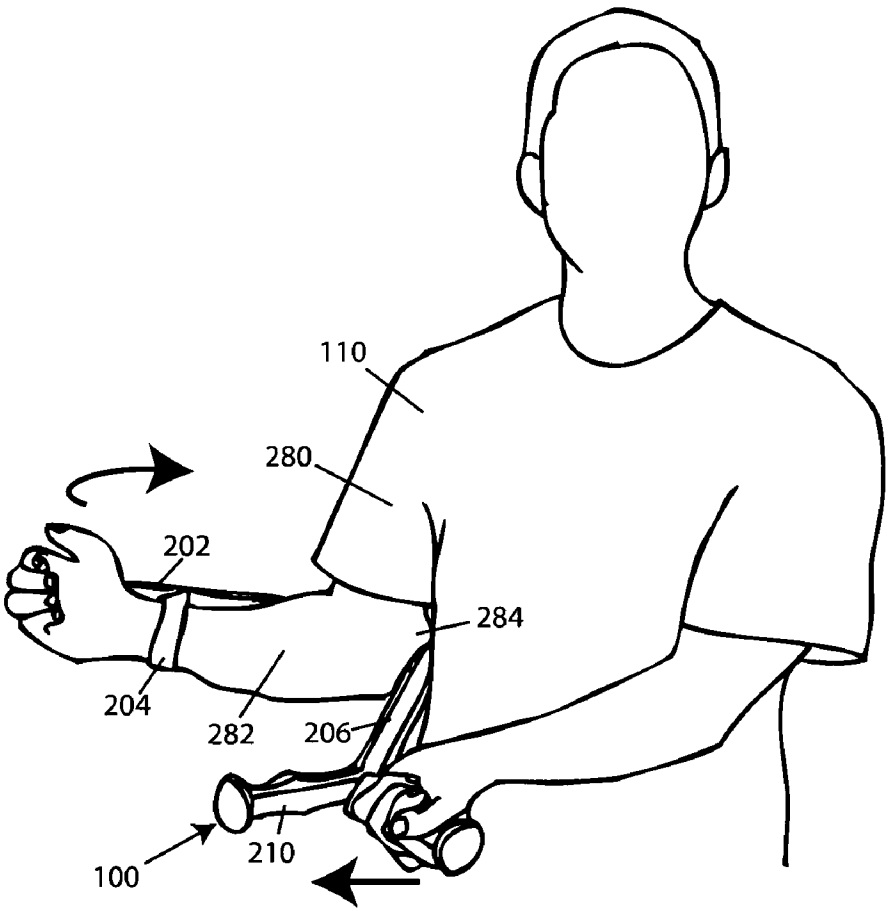
FIG. 6A shows a front view of a user holding the shoulder rehabilitation apparatus in an initial position for stretching the shoulder in another stretch plane.

FIG. 6A shows another example of an initial position for a shoulder stretching exercise in another plane in which the user's upper arm 280 extends downwardly against the torso, and the forearm 282 extends generally horizontally from the user's side so that the rotation member 206 extends forward from the user. The user can push a handle extension 210 in the direction indicated in FIG. 6A to stretch the shoulder in the desired plane, as shown in FIG. 6B.

Figure 7B:
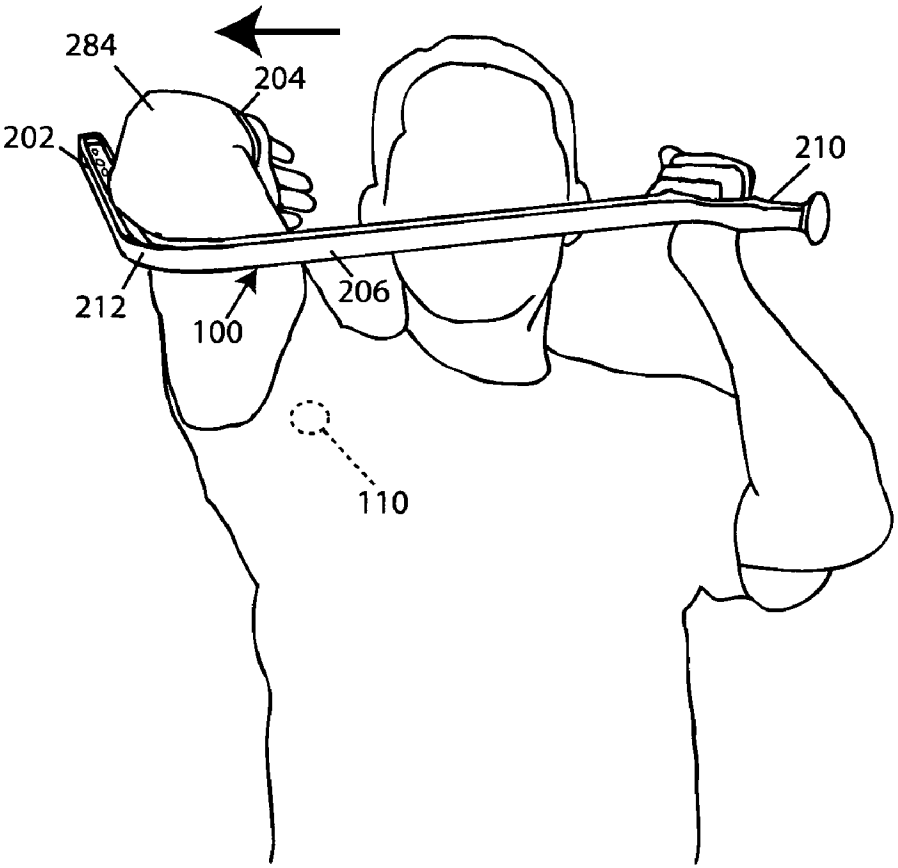
FIG. 7B shows a front view of a user holding the shoulder rehabilitation apparatus in FIG. 7A in a rotated position to stretch the shoulder.
Figure 7A:
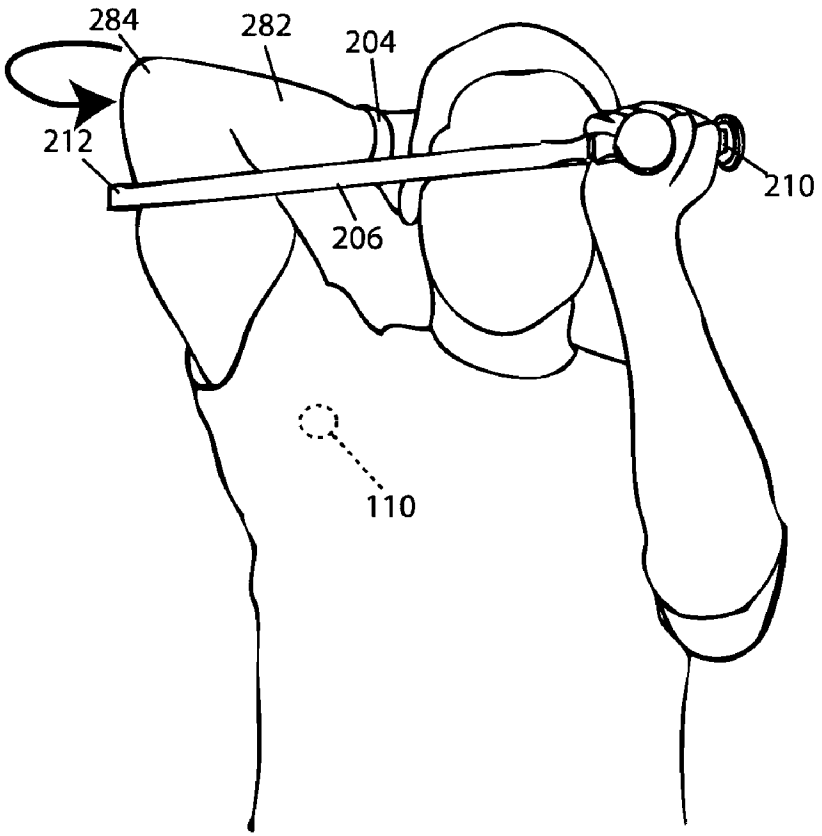
FIG. 7A shows a front view of a user holding the shoulder rehabilitation apparatus in an initial position for stretching the shoulder in another stretch plane.

FIG. 7A shows an example of an initial position for stretching the shoulder in another plane in which the user's forearm 282 is placed behind the head. The user may pull on a handle extension 210 in the direction indicated to rotate the forearm 282 in the direction shown to stretch the target shoulder 110 as shown in FIG. 7B.

Figure 8B:
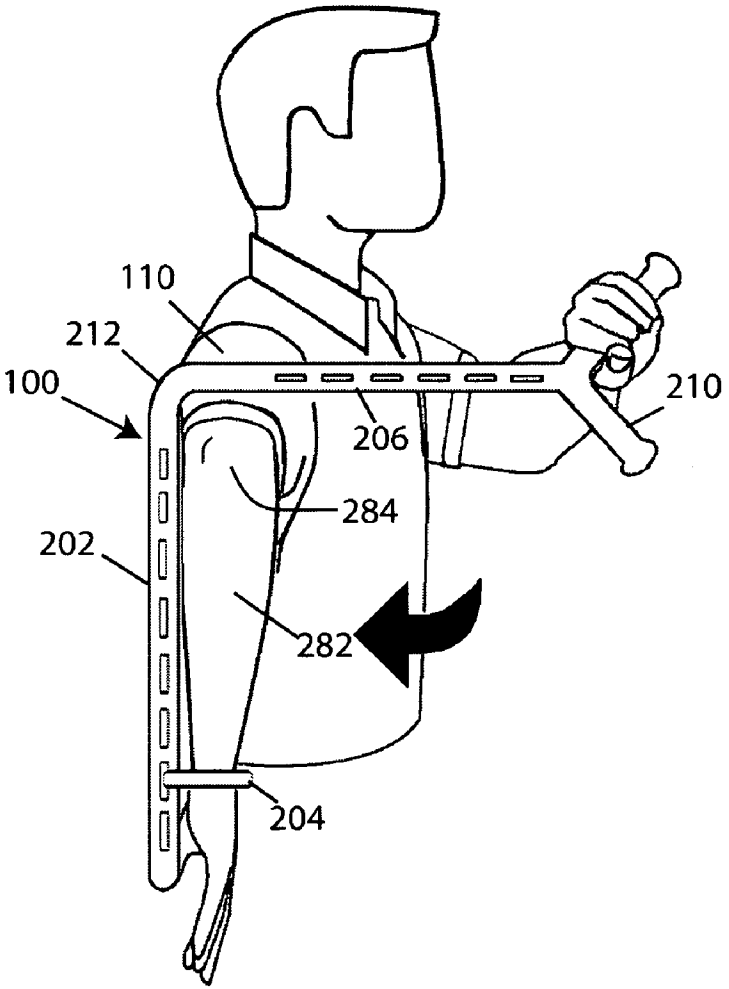
FIG. 8B shows a right side view of the shoulder rehabilitation apparatus and user of FIG. 8A in a rotated position to stretch the shoulder.
Figure 8A:
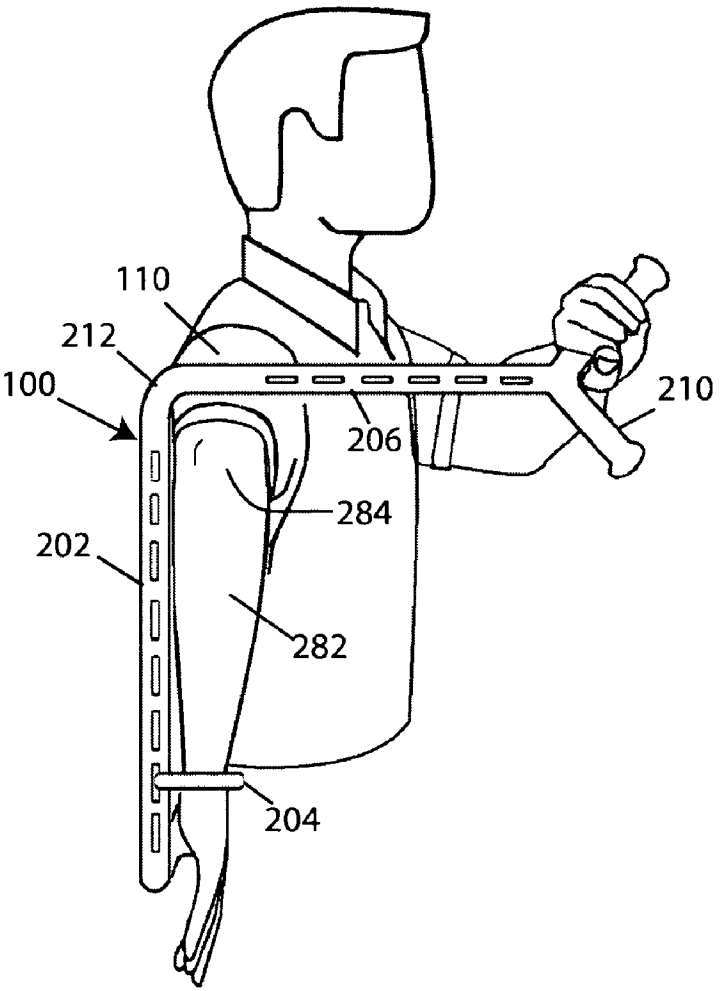
FIG. 8A shows a right side view of a user holding the shoulder rehabilitation apparatus in a first initial position to stretch the shoulder in another stretch plane.
Figure 9B:
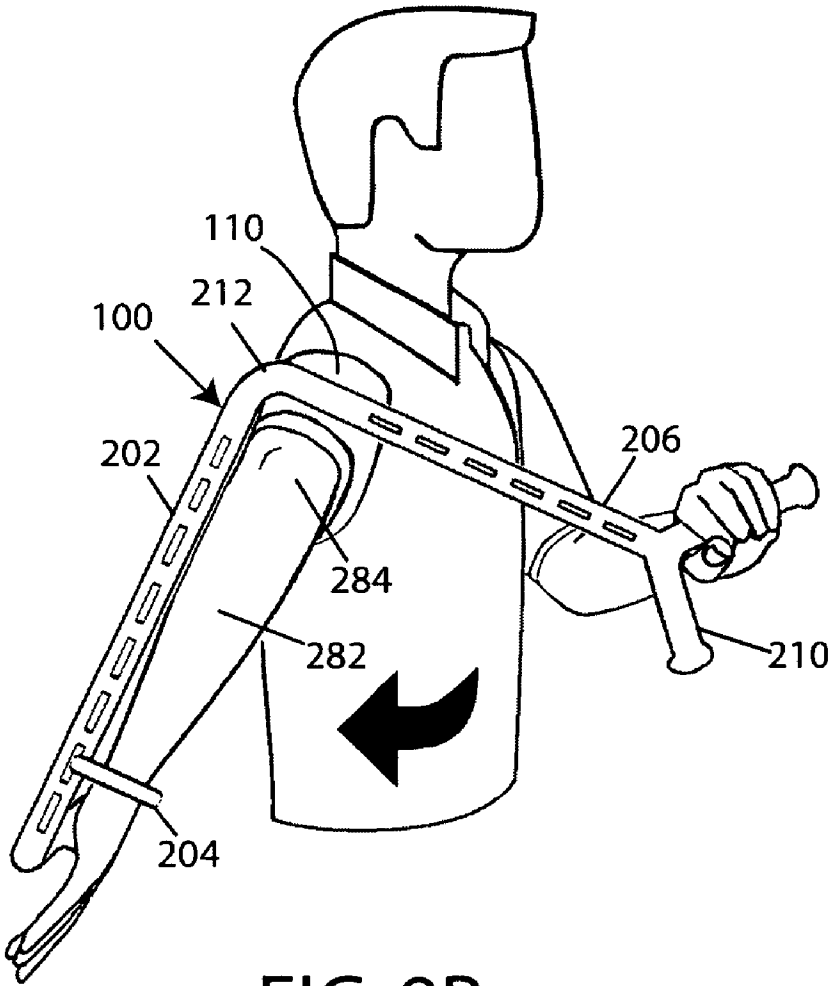
FIG. 9B shows a right side view of the shoulder rehabilitation apparatus and user of FIG. 8A in a rotated position to stretch the shoulder.
Figure 9A:
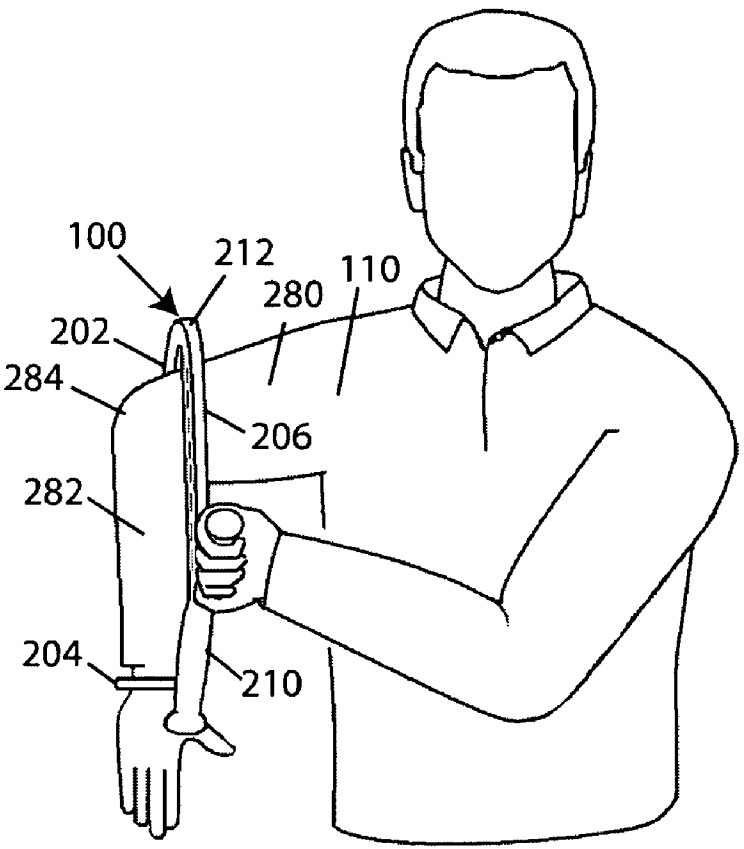
FIG. 9A shows a front view of the shoulder rehabilitation apparatus and user of FIG. 8A in a rotated position to stretch the shoulder.

FIGS. 8A-8B show an example of an internal rotation position that may be used to stretch a target shoulder 110. The initial position of FIGS. 8A-8B is similar to that of FIG. 4A except that the apparatus 100 is arranged so that the forearm support 202 extends downward so that in use the user's forearm 282 may be moved in an arcing motion upward and backward as the apparatus 100 is rotated as shown in FIGS. 9A-9B. The apparatus 100 holds the forearm in a generally downward position parallel to the body with the upper arm 280 extending to the side in a generally horizontal position. The user can rotate the apparatus 100 by grasping a handle extension 210 of the rotation member 206 of the apparatus 100 and moving the rotation member 206 downward so that the user's forearm 282 is moved upward and backward to stretch the target shoulder 110 (FIGS. 9A-9B).

Figure 10B:
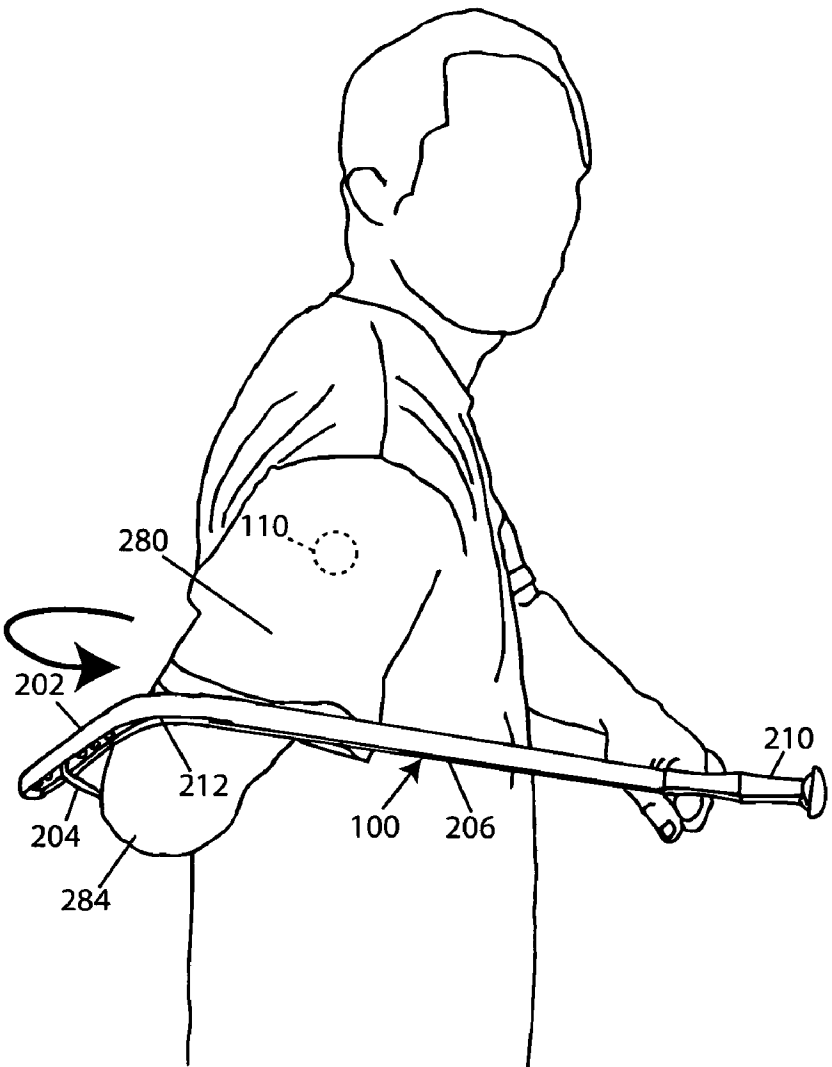
FIG. 10B shows a side view of a user holding the shoulder rehabilitation apparatus in FIG. 10A in a rotated position to stretch the shoulder.
Figure 10A:
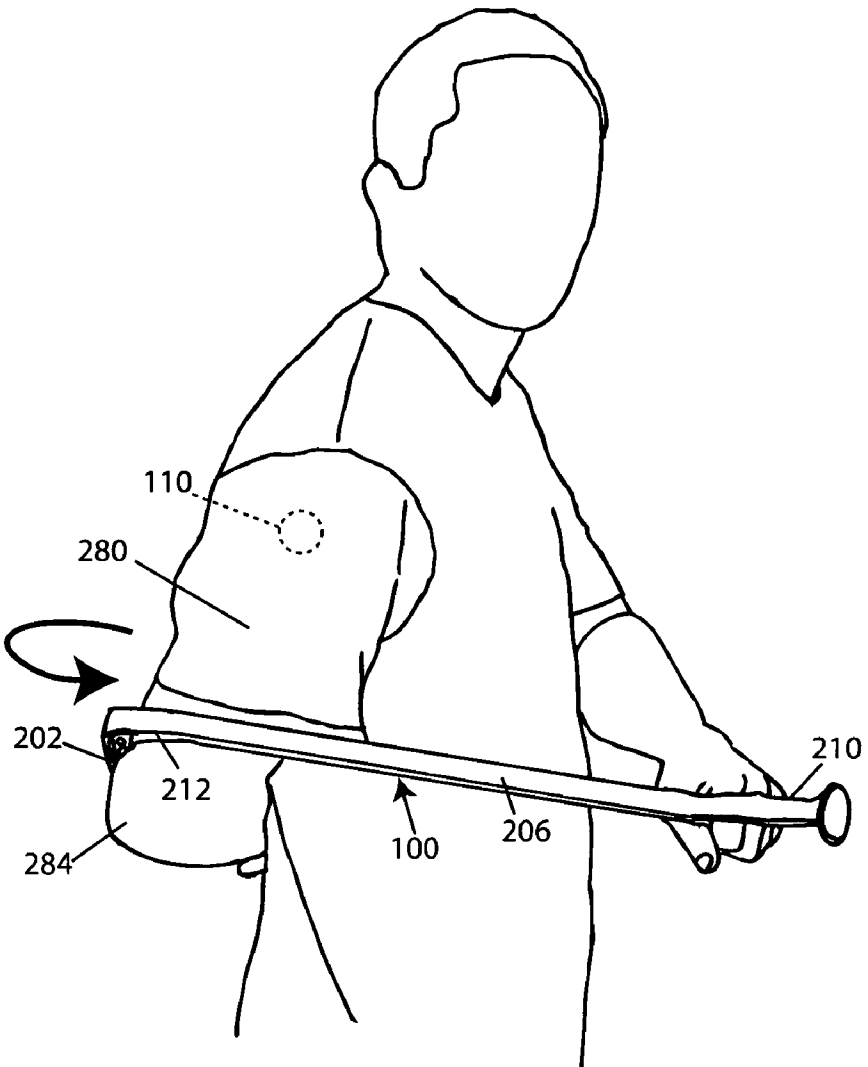
FIG. 10A shows a side view of a user holding the shoulder rehabilitation apparatus in an initial position for an rotation stretch in another stretch plane.

FIG. 10A shows an example of another stretching exercise in which in an initial position the user's arm is behind the back in a "handcuff" position. As shown in FIG. 10B, the user may pull on a handle extension 210 of the rotation member 206 to move the forearm 282 away from the body to stretch the shoulder 110.

As previously discussed in regard to FIG. 3C, the apparatus 100 may be provided with one or more resilient bands, such as surgical tubing 302, that allows a user to exercise the shoulder against the resistance. Thus, in addition to the various stretching techniques shown in FIGS. 4A-10B a user can also exercise the shoulder by moving the forearm 282 against the resilient band(s). For example, in addition to rotating the apparatus 100 to stretch the shoulder in a first direction, a user could work against the resilient band to exercise the shoulder in an opposite direction.

Furthermore, the stretching exercises shown in FIGS. 4A-10B are merely a few examples of the many different planes through which a user can stretch or exercise the shoulder as the user can stabilize the apparatus 100 in an infinite number of planes. In addition to stretching, flexing of the shoulder muscles may or may not be desirable depending upon the particular needs of a user. The user can exercise the shoulder as discussed above by moving the forearm 282 against a resilient band, such as surgical tubing (FIG. 3C) or a rubber band (not shown). For example, a user may hold the apparatus 100 in a desired position with a free hand and move the forearm 282 of the target shoulder against the resilient band. A user could expend a desired force by stretching the resilient band a predetermined length to obtain a desired force, such as by determining the spring constant of the resilient band. Other resilient band could be used such as a spring or other resilient materials.

The apparatus 100 may be formed of a unitary structure in which the forearm support 202, rotation member 206, handle 210, and elbow support 212 form an integral device. For example, the apparatus may be of a unitary construction of molded plastic. The apparatus 100 may be made of flexible material, such as ABS plastic, to allow a slight twisting of the rotation arm 206 when grasped by a user or a rigid material such as hardened plastic or metal to prevent flexing. Additional forearm securing means and resistance means may also be added. For example, one or more surgical tubing bands could be added to the rotation member 206 to allow for resistance exercise by moving the forearm against the rotation means. Although the present invention allows for self-stretching and self-exercising of the shoulder, the apparatus 100 may be used by a person other than the patient, such as a physical therapist or a certified athletic trainer, to provide assistance to the patient.

Again, the above-described and illustrated embodiments of the present invention are merely exemplary examples of implementations set forth for a clear understanding of the principles of the invention. Variations and modifications may be made to the above-described embodiments, and the embodiments may be combined, without departing from the scope of the following claims. While the exemplary embodiments are shown with the user in a standing position, the apparatus and methods could be performed with the user in other positions. Furthermore, although the apparatus was discussed in the context of therapeutic exercises for an injured shoulder, the apparatus and methods may be used as part of a stretching and exercise program for a healthy shoulder. For example, a patient may use the device to recuperate from surgery, such as the removal of the lymph nodes during breast cancer surgery, to prevent the common occurrence of "frozen shoulder." In addition, athlete may use the apparatus and methods to improve performance. For example, a baseball player may use the device to prepare for the throwing movement involved in a game and a golfer may use the device to increase performance when striking a golf ball. Furthermore, an elderly person may use the apparatus and methods to maintain shoulder flexibility and avoid potential age-related shoulder problems.

What is claimed is:

1. A shoulder apparatus, comprising:

an upright forearm support configured for placement behind a user's vertically positioned forearm, the forearm support having a front, a proximal end, and a distal end, the proximal end configured for placement behind a user's elbow, and the distal end configured for placement behind a user's wrist;

a strap for securing the wrist end of the user's forearm to the front of the distal end of the forearm support, the strap extending forward from the distal end of the forearm support;

a rotation member coupled perpendicular to the proximal end of the forearm support, the rotation member coplanar with the forearm support and having a proximal end and a distal end, the proximal end configured for placement under the user's elbow, and the distal end configured to extend in front of the user and allow rotation of said shoulder apparatus and rearward movement of the forearm support by movement of the rotation member in a direction toward the forearm support to thereby rotate the apparatus about the user's elbow and pull the user's forearm with the strap and apply a rotating force to the user's shoulder;

an elbow support provided at a junction of the forearm support and the rotation member to support the user's elbow, the elbow support coplanar with the forearm support and the rotation member, the elbow support comprising a curved portion extending between the rotation member and the forearm support configured to rotate about the user's elbow; and a handle provided at the distal end of said rotation member the handle configured for grasping by the user's free hand to move the rotation member and thereby rotate the elbow support about the user's elbow, the handle comprising a v-shaped member extending from the distal end of the rotation member.

2. The shoulder apparatus of claim 1, wherein said forearm support and said rotation member are positioned at about a 90 degree angle.

3. The shoulder apparatus of claim 1, wherein said elbow support is configured for placement under the user's elbow to position the arm in a desired position for rotation of the user's shoulder.

4. The shoulder apparatus of claim 1, further comprising an inclinometer for measuring rotation of the shoulder.

5. The shoulder apparatus of claim 4, wherein said inclinometer comprises a spirit level.

6. The shoulder apparatus of claim 4, wherein said inclinometer comprises an angle finder.

7. The shoulder apparatus of claim 1, wherein said strap comprises an adjustable strap.

8. The shoulder apparatus of claim 1, wherein said strap is resilient to allow a user to stretch the securing means to exercise the shoulder.

9. The shoulder apparatus of claim 1, wherein said rotation member is flexible.

10. The shoulder apparatus of claim 1, further comprising a resilient band to provide resistance against the force of rotation of a user's forearm away from the forearm support.

11. The shoulder apparatus of claim 1, wherein said strap is a resilient strap.

12. The shoulder apparatus of claim 11, wherein said resilient strap has a predetermined resistance.

13. The shoulder apparatus of claim 1, further comprising receiving apertures in said forearm support member for receiving said strap.

14. A method of stretching a shoulder of a user, comprising:

securing a distal end of a forearm support of a shoulder apparatus behind a forearm of the user, the forearm support coupled to a rotation member, the rotation member extending generally perpendicular to the forearm support and forward of the user;

supporting an elbow of the user to be exercised by an elbow support located between the forearm support and the rotation member so that a shoulder acts as a pivot point for rotation of the forearm support; and moving the rotation member to rotate the shoulder apparatus about the user's elbow and move the forearm support to pull the user's forearm in a rearward direction and rotate the user's shoulder.

15. The method of claim 14, further comprising:

measuring the rotation of the apparatus to determine the stretch of the shoulder.

16. The method of claim 14, further comprising securing said forearm to a resilient band.

17. The method of claim 16, further comprising moving the forearm against a resilient band attached to said forearm support to exercise the shoulder.

18. A device for stretching a shoulder, comprising:

a generally L-shaped member having an upright forearm support configured for placement behind a user's vertically positioned forearm, an elbow support to support a user's elbow, a strap for securing a user's forearm to the forearm support, a rotation member coupled to the forearm support so that a user may through self-assistance stretch the shoulder both internally and externally by applying force to the rotation member to rotate the L-shaped member and stretch the user's shoulder.

* * * * *